US007046217B2

(12) United States Patent
Choi

(10) Patent No.: US 7,046,217 B2
(45) Date of Patent: May 16, 2006

(54) ENERGY RECOVERY APPARATUS FOR PLASMA DISPLAY PANEL

(75) Inventor: Jeong Pil Choi, Kyungki-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/947,534

(22) Filed: Sep. 23, 2004

(65) Prior Publication Data

US 2005/0140586 A1 Jun. 30, 2005

Related U.S. Application Data

(63) Continuation-in-part of application No. 09/790,620, filed on Feb. 23, 2001.

(30) Foreign Application Priority Data

Feb. 24, 2000 (KR) ..... 2000-8944
Apr. 15, 2000 (KR) ..... 2000-19763
May 10, 2000 (KR) ..... 2000-25110

(51) Int. Cl.
*G09G 3/14* (2006.01)

(52) U.S. Cl. ..... 345/46; 345/44; 345/60

(58) Field of Classification Search ..... None
See application file for complete search history.

(56) References Cited

U.S. PATENT DOCUMENTS

| | | | | |
|---|---|---|---|---|
| 4,707,692 | A | 11/1987 | Higgins et al. | |
| 4,772,884 | A | 9/1988 | Weber et al. | |
| 4,866,349 | A | 9/1989 | Weber et al. | |
| 5,081,400 | A | 1/1992 | Weber et al. | |
| 5,438,290 | A | 8/1995 | Tanaka | |
| 5,670,974 | A | 9/1997 | Ohba et al. | |
| 6,011,355 | A | 1/2000 | Nagai | |
| 6,111,556 | A | 8/2000 | Moon | |
| 6,150,999 | A | 11/2000 | Chen et al. | |
| 6,175,192 | B1 | 1/2001 | Moon | |
| 2005/0012690 | A1 * | 1/2005 | Choi | 345/60 |

* cited by examiner

*Primary Examiner*—Tuyet Thi Vo
(74) *Attorney, Agent, or Firm*—Fleshner & Kim, LLP

(57) ABSTRACT

An energy recovery apparatus for a plasma display panel is provided that may include a capacitor equivalently formed at a discharge cell, an inductor, an energy recovery capacitor, switching units and a voltage sustain diode. The inductor may form a resonance circuit together with the capacitor. The energy recovery capacitor may recover energy of the capacitor thus to be charged. The switching units may be installed between the capacitor and the energy recovery capacitor, for controlling a charging/discharging of the capacitor. The voltage sustain diode may be installed between the inductor and a ground voltage source, for preventing a voltage between the inductor and the capacitor from being dropped to a voltage less than a ground voltage.

8 Claims, 12 Drawing Sheets

ENERGY RECOVERY APPARATUS FOR PLASMA DISPLAY PANEL

This application is a continuation-in-part of U.S. patent application Ser. No. 09/780,620, filed on Feb. 23, 2001, the subject matter of which is incorporated herein by reference. U.S. patent application Ser. No. 09/780,620 claims priority under 35 U.S.C. §119 from Korean Patent Application Nos. 8944/2000 filed Feb. 24, 2000, 19763/2000 filed Apr. 15, 2000, and 25110/2000 filed May 10, 2000, the entire disclosures are incorporated herein by reference.

BACKGROUND OF THE INVENTION

1. Field of the Invention

The present invention relates to an energy recovery apparatus for a plasma display panel, and more particularly, to an energy recovery apparatus for a plasma display panel capable of performing a stable operation.

2. Description of the Related Art

A plasma display panel (PDP) is a device for displaying a picture and it has been known as a gas discharge display device. Discharge gases are filled up between upper and lower panels of the plasma display panel, and an ultraviolet ray generated through the gas discharge exciting red, green and yellow fluorescents, which are formed at least one of the upper and lower panels thereby to generate visible lights. When compared with a cathode ray tube that has been served as a main display means, the PDP is thinner and lighter and realizes a clearer and larger screen. The PDP is composed of a plurality of discharge cells arranged as a matrix form, and one discharge cell constitutes one pixel of a screen.

FIG. 1 is a perspective view showing a discharge cell structure of an AC-type plasma display panel in accordance with the related art.

Referring to FIG. 1, a discharge cell of the related art AC type PDP includes: a scan electrode 12Y and a sustain electrode 12Z formed on an upper substrate 10; and an address electrode 20X formed on a lower substrate 18. On the upper substrate 10 where the scan electrode 12Y and the sustain electrode 12Z are formed in parallel, the upper dielectric layer 14 and a passivation layer 16 are formed. Awall charge generated at the time of a plasma discharge is accumulated on the upper dielectric layer 14. The passivation layer 16 prevents the upper dielectric layer 14 from being damaged due to a sputtering generated at the time a plasma discharge, and enhances an efficiency of a secondary electron emission. As the passivation layer 16, MgO is generally used.

A lower dielectric layer 22 and a partition wall 24 are formed on the lower substrate 18 where the address electrode 20X is formed, and a fluorescent substance 26 is deposited on the surface of the lower dielectric layer 22 and the partition wall 24. The address electrode 20X is formed in a direction crossing the scan electrode 12Y and the sustain electrode 12Z. The partition wall 24 is formed in parallel to the address electrode 20X thereby to prevent ultraviolet rays and visible rays from being leaked to adjacent discharge cells. The fluorescent substance 26 is excited by ultraviolet rays generated at the time of a plasma discharge, and generates one visible ray of R, G, and B. Inactive gas for a gas discharge is injected into a discharge space formed between the upper/lower substrates 10/18 and the partition wall 24.

Referring to FIG. 2, a driving apparatus for driving the related art AC-type PDP comprises: a PDP 30 arranged as a matrix form so that m×n discharge cells 1 can be accessed to scan electrode lines (Y1 to Ym), sustain electrode lines (Z1 to Zm), and address electrode lines (X1 to Xn); a scan driving unit 32 for driving the scan electrode lines (Y1 to Ym); a sustain driving unit 34 for driving the sustain electrode lines (Z1 to Zm); and first and second driving units 36A and 36B for division-driving the odd number address electrode lines (X1, X3, . . . Xn−3, Xn−1) and the even number address electrode lines (X2, X4, . . . Xn−2, Xn).

The scan driving unit 32 sequentially supplies a scan pulse and a sustain pulse to the scan electrode lines (Y1 to Ym) so that the discharge cells 1 are sequentially scanned as a line unit and a discharge is continuously performed at each m×n discharge cells 1. The sustain driving unit 34 supplies a sustain pulse to all the sustain electrode lines (Z1 to Zm). The first and second address driving units 36A and 36B supply image data to the address electrode lines (X1 to Xn) to be synchronized by the scan pulse. The first address driving unit 36A supplies image data to the odd numbered of address electrode lines (X1, X3, . . . Xn−3, Xn−1), and the second address driving unit 36B supplies image data to the even number address electrode lines (X2, X4 . . . Xn−2, Xn).

In the AC-type PDP, a high voltage more than several hundreds of volts is required to an address discharge and a sustain discharge. According to this, an energy recovery apparatus is installed at the scan driving unit 32, the sustain driving unit 34, and the address driving units 36A and 36B in order to minimize a driving power necessary to the address discharge and the sustain discharge. The energy recovery apparatus recovers a voltage charged to a panel, and the recovered voltage is used as a driving voltage of the next discharge.

FIG. 3 is a view showing an energy recovery apparatus installed at a front end of an address driving unit in accordance with related art.

Referring to FIG. 3, the related art energy recovery apparatus 40 comprises: an inductor L connected between the first address driving unit 36A and an energy recovery capacitor Cs; first and third switches S1 and S3 connected in parallel between the energy recovery capacitor Cs and the inductor L; and second and fourth switches S2 and S4 connected in parallel between the inductor L and the first address driving unit 36A. A panel capacitor Cp equivalently shows a static capacitance of a PDP discharge cell.

The second switch S2 is connected to a voltage source Vd, and the fourth switch S4 is connected to a ground voltage source GND. The energy recovery capacitor Cs recovers a voltage charged to the panel capacitor Cp thus to be charged at the time of an address discharge, and re-supplies the charged voltage to the panel capacitor Cp. The energy recovery capacitor Cs charges a voltage corresponding to a half of the address voltage Vd. The inductor L forms a resonance circuit together with the panel capacitor Cp. The first to fourth switches S1 to S4 charges a voltage to the energy recovery capacitor Cs by being turned on or turned off, or supplies the charged voltage to the panel capacitor Cp.

The first address driving unit 36A is provided with a plurality of fifth and sixth switches S5 and S6. The fifth switch S5 is connected to the energy recovery apparatus, and the sixth switch S6 is connected to the ground voltage source GND. The fifth switch S5 is turned on when a data pulse is supplied to the first address driving unit, and is turned off when the data pulse is not supplied thereto. An energy recovery apparatus formed at the second address driving unit 36B is symmetrical with the first address driving unit 36A and the energy recovery apparatus 40 with the panel capacitor Cp as a center.

FIG. 4 is a view showing turn-on/off time of the switches of FIG. 3 and voltages supplied to the panel capacitor.

Operation of the energy recovery apparatus 40 will be explained in more detail with reference to FIGS. 3 and 4.

At the initial state prior to the period of T1, a voltage of the panel capacitor Cp is supposed as 0. Also, a charged voltage of the energy recovery capacitor Cs is supposed to be Vd/2. In the period of T1, the first and fifth switches S1 and S5 are turned on. At this time, if a discharge cell is not selected, that is, if a data pulse is not supplied to the address electrode line X, the fifth switch S5 sustains the turn-off state. When the first and fifth switches S1 and S5 are turned on, a current path connected to the panel capacitor Cp from the energy recovery capacitor Cs via the first switch S1, the inductor L, the fifth switch S5 is formed. According to this, the charged voltage of the energy recovery capacitor Cs is supplied to the panel capacitor Cp. Since the inductor L and the panel capacitor Cp form a serial resonance circuit, the Vd is supplied to the panel capacitor Cp.

In the period of T2, the second switch S2 is turned on. If the second switch S2 is turned on, the address voltage Vd is supplied to the panel capacitor Cp. The supplied address voltage Vd prevents a voltage of the panel capacitor Cp from being dropped to a voltage less than the address voltage Vd thereby to cause a stable address discharge. Since the voltage of the panel capacitor Cp is increased up to the address voltage Vd in the period of T1, an external driving power for generating an address discharge is minimized.

In the period of T3, the first switch S1 is turned off, and the second switch S2 sustains the turned-on state. According to this, the panel capacitor Cp sustains the address voltage Vd in the period of T3.

In the period of T4, the second switch S2 is turned off, and the third switch S3 is turned on. When the third switch S3 is turned on, a current path connected to the energy recovery capacitor Cs from the panel capacitor Cp via the fifth switch S5, the inductor L, and the third switch S3 is formed. According to this, the charged voltage of the panel capacitor Cp is recovered to the energy recovery capacitor Cs.

In the period of T5, the third and fifth switches S3 and S5 are turned off, and the fourth and sixth switches S4 and S6 are turned on. If the fourth and sixth switches S4 and S6 are turned on, a current path is formed between the ground voltage GND and the panel capacitor Cp thereby to lower the voltage of the panel capacitor Cp into 0. In the conventional energy recovery apparatus, operations during the periods of TI to T5 are repeated thereby to supply a data pulse to the panel capacitor Cp.

However, in the related art energy recovery apparatus, since a supplied data pulse has a relatively wide pulse width, high speed addressing may be impossible. Referring to FIG. 5, a data pulse supplied from the energy recovery apparatus is divided into the period of T1 for charging a voltage to the panel capacitor Cp, the period of T2 for supplying an address voltage to the panel capacitor Cp, the period of T3 for recovering the voltage charged to the panel capacitor Cp and charging to the energy recovery capacitor Cs, and the period of T4 for lowering the voltage of the panel capacitor Cp into 0.

The period of T2 is substantially necessary for an address discharge. The periods T1, T3, and T4 are preliminary periods for charging a voltage to the capacitors Cs and Cp. That is, in the related art, an addressing of a high speed is not performed due to the preliminary periods T1, T3, and T4 except the period of T2.

In the related art energy recovery apparatus 40, a consumption power amount can be reduced when a variation of data supplied to the address electrode lines X is great. However, in case of a full white and a blank data having no data variation, power is wasted by unnecessary switching operation of the energy recovery apparatus. In case of the full white, address data has to be supplied to all the address electrode lines X. At this time, the address driving unit has to output a data pulse. However, since the energy recovery apparatus 40 performs an unnecessary switching operation even in this case, much power is wasted. Therefore, in the related art, the energy recovery apparatus 40 is not operated in case of the full white and the blank data. However, since the energy recovery apparatus 40 is turned on/off only in case of the full white and the blank data, unnecessary power consumption is caused at many positions.

In order to solve the problem of the related art energy recovery apparatus 40 of FIG. 3, the applicant of the present invention has proposed a power recovery apparatus 50 of FIG. 6 in Korean patent registration No. 10-0330032 (application No. 2000-19763), the subject mater of which is incorporated herein by reference.

Referring to FIG. 6, the energy recovery apparatus 50 includes: an inductor L connected between a first address driving unit 36A and an energy recovery capacitor Cs; first and third switches S1 and S3 connected in parallel between the energy recovery capacitor Cs and the inductor L; and a second switch S2 connected between the inductor L and the first address driving unit 36A. A panel capacitor Cp equivalently shows a static capacitance of a discharge cell.

The second switch S2 is connected to the address voltage Vd. The energy recovery capacitor Cs recovers the voltage charged to the panel capacitor Cp thus to be charged, and re-supplies the charged voltage to the panel capacitor Cp. At this time, the voltage charged to the energy recovery capacitor Cs is varied according to supplied data. The inductor L forms a resonance circuit together with the panel capacitor Cp. The first to third switches (S1 to S3) charge a voltage to the energy recovery capacitor Cs by being turned on/off, or supply the charged voltage to the panel capacitor Cp.

The first address driving unit 36A is provided with a plurality of fourth and fifth switches S4 and S5. The fourth switch S4 is connected to the energy recovery apparatus 50, and the fifth switch S5 is connected to a ground voltage GND. The fourth switch S4 is turned on when a data pulse is supplied to the first address driving unit, and is turned off when a data pulse is not supplied thereto. The_energy recovery apparatus formed at the second address driving unit 36B is symmetrical with the first address driving unit 36A and the energy recovery apparatus 40 with the panel capacitor Cp as a center.

FIG. 7 is a view showing turn-on/off times of the switches of FIG. 6 and voltages supplied to the panel capacitor.

Operation of the energy recovery apparatus 50 will be explained with reference to FIGS. 6 and 7.

At the initial state prior to the period of T1, a voltage of the panel capacitor Cp is supposed as 0. Also, it is supposed that a predetermined voltage is charged to the energy recovery capacitor Cs.

In the period of T1, the first and fourth switches S1 and S4 are turned on. At this time, if a discharge cell is not selected, that is, if a data pulse is not supplied to the panel capacitor Cp, the fourth switch S4 sustains the turn-off state. When the first and fourth switches S1 and S4 are turned on, a current path from the energy recovery capacitor Cs to the panel capacitor Cp via the first switch S1, the inductor L, the fourth switch S4 is formed. The inductor L and the panel capacitor Cp form a serial resonance circuit thereby to supply the address voltage Vd to the panel capacitor Cp.

In the period of T2, the second switch S2 is turned on. If the second switch S2 is turned on, the address voltage Vd is supplied to the panel capacitor Cp. The supplied address voltage Vd prevents the voltage of the panel capacitor Cp from being dropped to a voltage less than the address voltage Vd thereby to cause a stable address discharge.

In the period of T3, the first switch S1 is turned off, and the second switch S2 sustains the turned-on state. According to this, the panel capacitor Cp sustains the address voltage Vd in the period of T3.

In the period of T4, the second switch S2 is turned off, and the third switch S3 is turned on. When the third switch S3 is turned on, a current path connected from the panel capacitor Cp to the energy recovery capacitor Cs via the fifth switch S5, the inductor L, and the third switch S3 is formed. According to this, the charged voltage of the panel capacitor Cp is recovered to the energy recovery capacitor Cs.

In the period of T5, an address pulse is supplied to the address electrode line X by repeating the operation during the period of T1. Substantially, a data pulse is supplied to the panel capacitor Cp by repeating the operations during the periods of T1 to T4.

Referring to FIG. 8, a data pulse generated from the related art energy recovery apparatus of FIG. 6 is divided into the period of T1 for charging a voltage to the panel capacitor Cp, the period of T2 for supplying the address voltage Vd to the panel capacitor Cp, and the period of T3 for recovering the voltage charged to the panel capacitor Cp and charging to the energy recovery capacitor Cs. In the energy recovery apparatus of FIG. 6, the period of T4 for sustaining the voltage of the energy recovery capacitor Cs as Vd/2 is removed thereby to enable an addressing of a high speed.

However, in the energy recovery apparatus shown in FIG. 6, a negative voltage or a positive voltage can be instantaneously applied to a first node n1 due to the switching operation of the address driving unit or the operation of another circuit. If a negative voltage or a positive voltage is instantaneously applied to the first node n1, a mis-operation of the energy recovery apparatus 50 may be generated or a circuit device may be damaged.

SUMMARY OF THE INVENTION

Therefore, an object of the present invention is to provide to an energy recovery apparatus for a plasma display panel capable of performing stable driving.

To achieve these and other advantages and in accordance with the purpose of the present invention, as embodied and broadly described herein, there is provided an energy recovery apparatus for a plasma display panel comprising: a capacitor equivalently formed at a discharge cell; an inductor for forming a resonance circuit together with the capacitor; an energy recovery capacitor for recovering the energy of the capacitor thus to be charged; switching units installed between the capacitor and the energy recovery capacitor, for controlling a charging/discharging of the capacitor; and a voltage sustain diode installed between the inductor and a ground voltage source, for preventing a voltage between the inductor and the capacitor from being dropped to a voltage less than a ground voltage.

The switching units do not include a switching unit installed between the capacitor and the ground voltage source so as to omit a reset period for connecting the capacitor and the ground voltage source.

The switching units include: first and second switching units connected in parallel between the inductor and an external capacitor; and a third switching unit installed between the inductor and an address driving unit and connected to an address voltage source.

A voltage limiting diode is further provided between the inductor and the address voltage source in order to prevent a voltage between the inductor and the capacitor from being increased to a voltage more than the address voltage.

The energy recovery apparatus for a plasma display panel comprises: a capacitor equivalently formed at a discharge cell; an inductor for forming a resonance circuit together with the capacitor; an energy recovery capacitor for recovering energy of the capacitor thus to be charged; switching units installed between the capacitor and the energy recovery capacitor, for controlling a charging/discharging of the capacitor; and a voltage sustain diode installed between the inductor and a ground voltage source, for preventing a voltage between the inductor and the capacitor from being dropped to a voltage less than a ground voltage.

The energy recovery apparatus is further provided with an address voltage source, and a second switching unit installed between the address voltage source and the inductor and turned on when a voltage of the capacitor is sustained as a voltage of the address voltage source.

A voltage limiting diode is further provided between the inductor and the address voltage source in order to prevent a voltage between the inductor and the capacitor from being increased to a voltage more than the address voltage.

The foregoing and other objects, features, aspects and advantages of the present invention will become more apparent from the following detailed description of the present invention when taken in conjunction with the accompanying drawings.

The energy recovery apparatus for a plasma display panel comprises: an address electrode driving unit having a power supply unit to supply drive power to each of a plurality of address electrode lines of a plasma display panel; an external capacitor to recover a charged voltage from capacitance loads formed on each of the plurality of address electrode lines, the voltage charged in the capacitor varying according to an amount of data on the plurality of the address electrode lines; an inductor to form a resonant circuit with the capacitance loads so as to charge and discharge the external capacitor; a switching device unit connected between the inductor and the external capacitor, the switching device controlling charging and discharging of the external capacitor; a voltage sustain diode installed between the inductor and a ground voltage source, for preventing a voltage between the inductor and the capacitance loads from being dropped to a voltage less than a ground voltage; and a voltage limiting diode installed between the inductor and the address voltage source in order to prevent a voltage between the inductor and the capacitance loads from being increased to a voltage more than the address voltage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENTS

Reference will now be made in detail to the preferred embodiments of the present invention, examples of which are illustrated in the accompanying drawings.

An energy recovery apparatus for a plasma display panel will be explained with reference to FIGS. 9 to 13.

Figure 9:
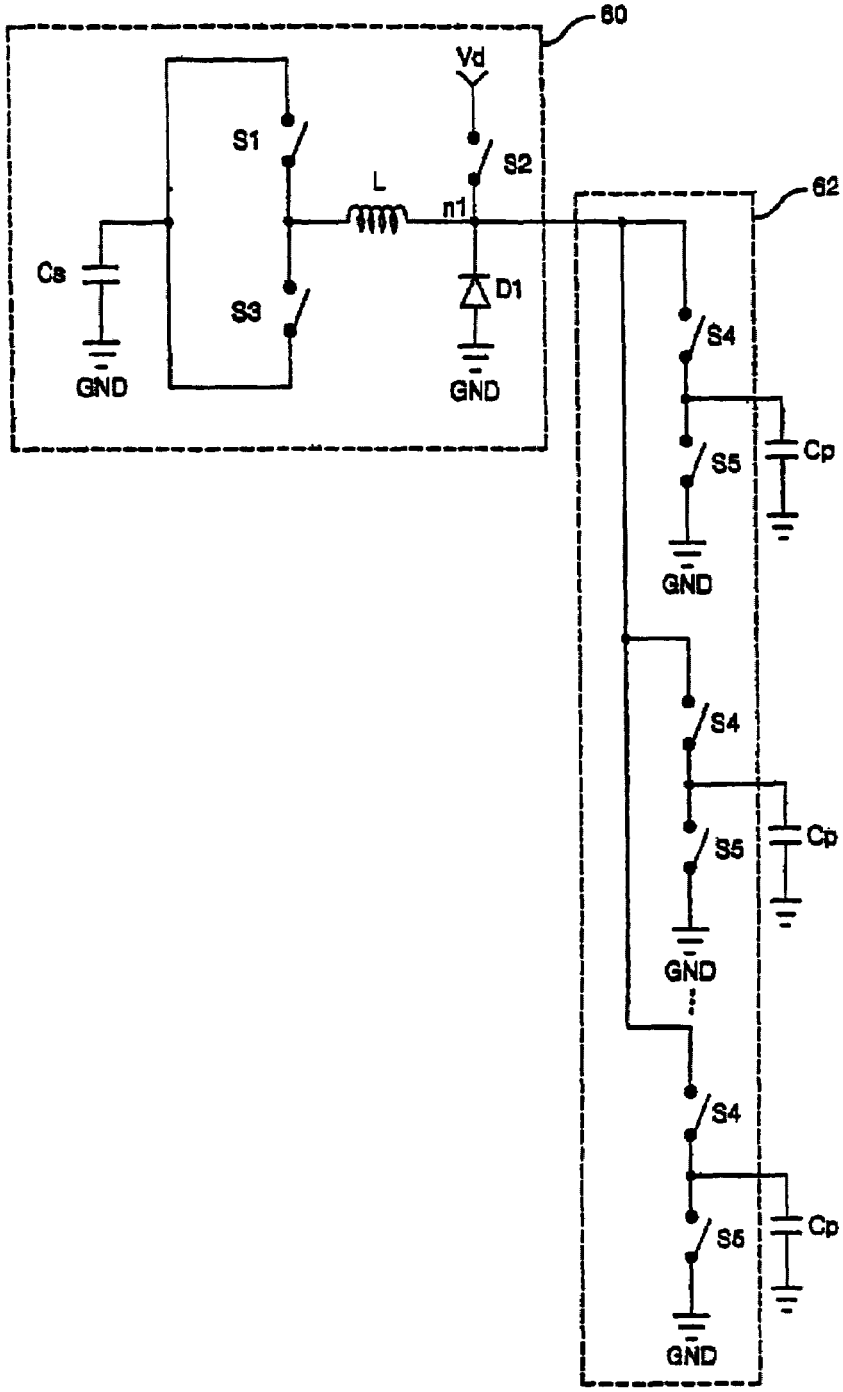
FIG. 9 is a circuit diagram showing an energy recovery apparatus according to one embodiment of the present invention.

FIG. 9 is a view showing an energy recovery apparatus according to one embodiment of the present invention.

Referring to FIG. 9, an energy recovery apparatus 60 according to one embodiment of the present invention comprises: an inductor L connected between an address driving unit 62 and an energy recovery capacitor Cs; first and third switches S1 and S3 connected between the energy recovery capacitor Cs and the inductor L in parallel; and a second switch S2 and a diode D1 connected between the inductor L and the address driving unit 62. A panel capacitor Cp shows a static capacitance of a discharge cell.

The second switch S2 is connected to a voltage source Vd. The energy recovery capacitor Cs recovers a voltage charged to the panel capacitor Cp thus to be charged, and re-supplies the charged voltage to the panel capacitor Cp. At this time, the voltage charged to the energy recovery capacitor Cs is varied according to supplied data. The inductor L forms a resonance circuit together with the panel capacitor Cp. The first to third switches (S1 to S3) charge a voltage to the energy recovery capacitor Cs by being turned on/off, or supply the charged voltage to the panel capacitor Cp. The diode D1 prevents a voltage of the first node n1 from being dropped to a voltage less than a ground voltage.

The diode D1 is connected between the first node n1 and the ground voltage source GND. The diode D1 shields a voltage supplied from the first node n1, and is installed to supply a voltage to the first node n1 from the ground voltage source GND. When the energy recovery apparatus 60 is normally operated, a potential of the first node n1 is set to be more than the ground voltage. Therefore, when the energy recovery apparatus 60 is normally operated, a current does not flow to the diode D1. When a negative voltage is applied to the first node n1 due to a switching operation of the address driving unit 62 or an operation of another circuit, the first node n1 and the ground voltage source GND are connected to each other via the diode D1. At this time, a potential of the first node n1 is sustained as the ground voltage. That is, the energy recovery apparatus 60 prevents the potential of the first node n1 from being dropped to a voltage less than the ground voltage source GND. According to this, the energy recovery apparatus 60 can be stably operated.

The address driving unit 62 is provided with a plurality of fourth and fifth switches S4 and S5. The fourth switch S4 is connected to the energy recovery apparatus 60, and the fifth switch S5 is connected to the ground voltage source GND. The fourth switch S4 is turned on when a data pulse is supplied to the address driving unit, and is turned off when the data pulse is not supplied thereto.

Figure 1:
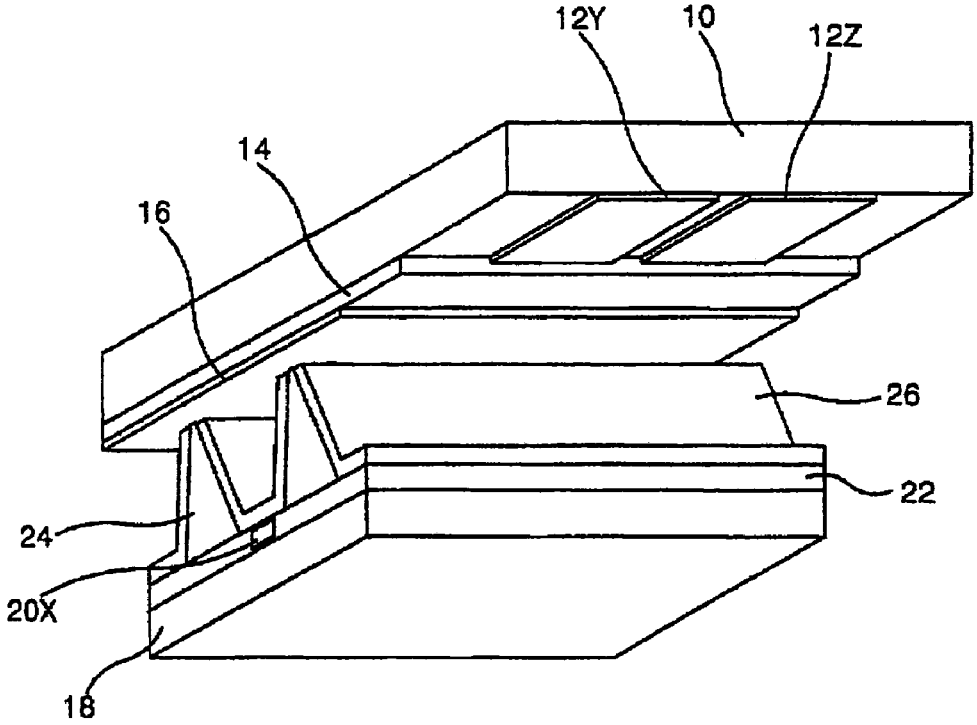
FIG. 1 RELATED ART
FIG. 1 is a perspective view showing a discharge cell structure of an AC type plasma display panel in accordance with the related art.
Figure 2:
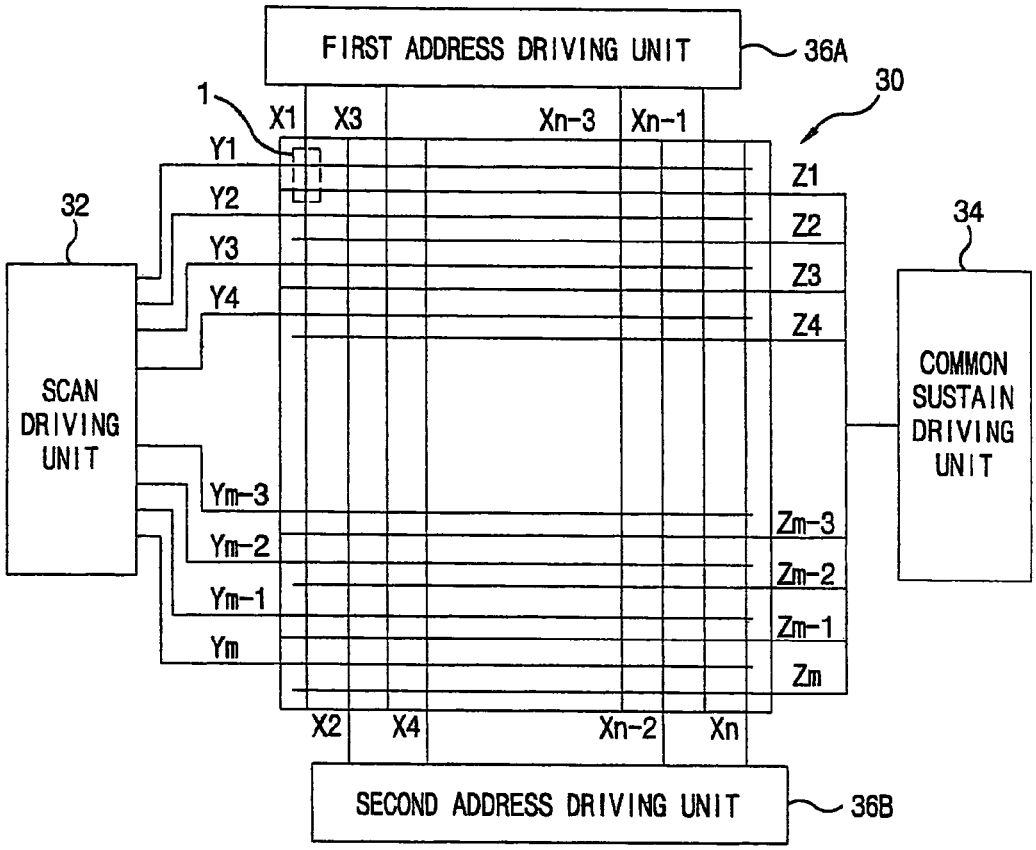
FIG. 2 RELATED ART
FIG. 2 is a view showing driving units for driving a plasma display panel in accordance with the related art.
Figure 3:
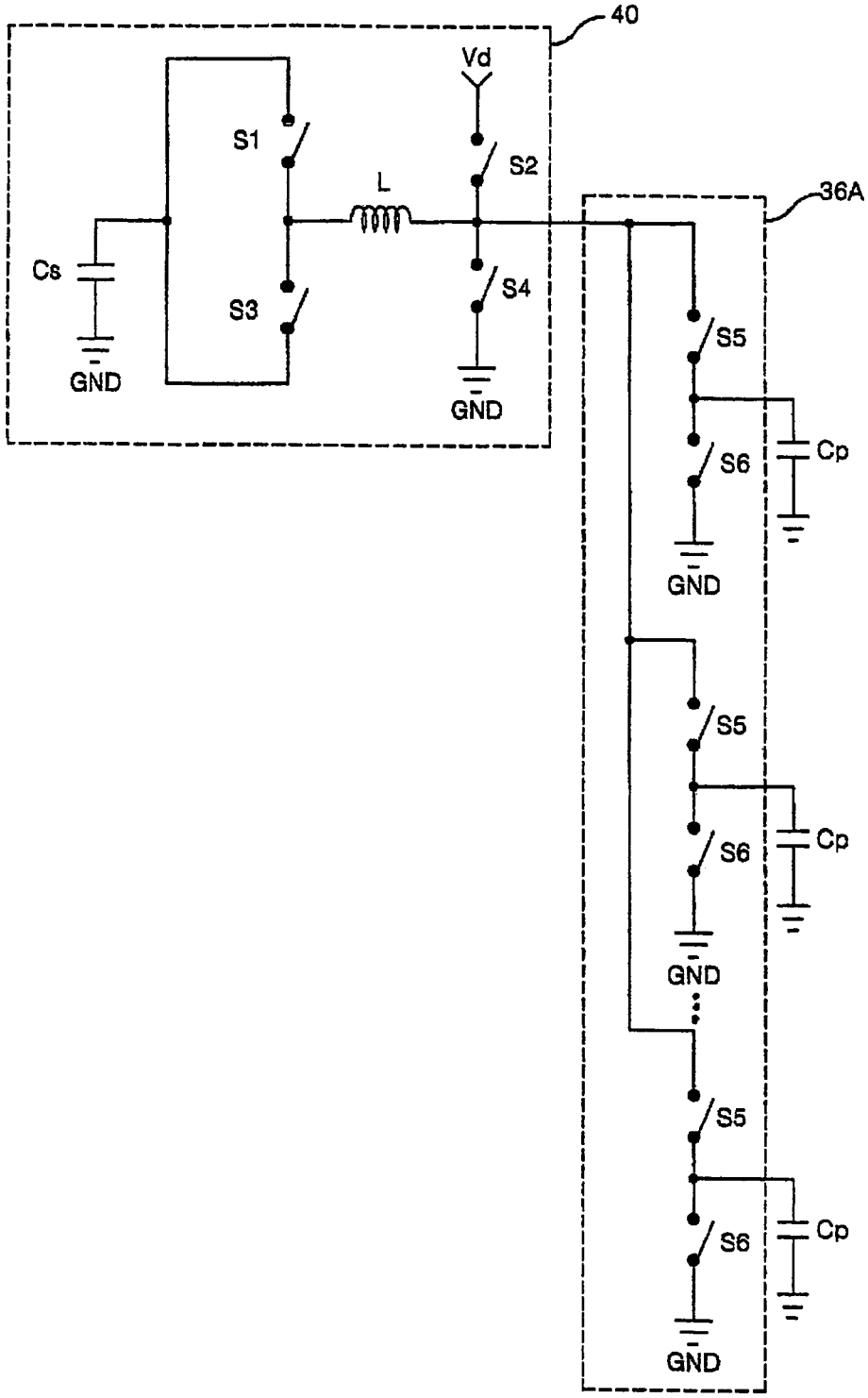
FIG. 3 RELATED ART
FIG. 3 is a view showing an energy recovery apparatus of the related art plasma display panel.
Figure 4:
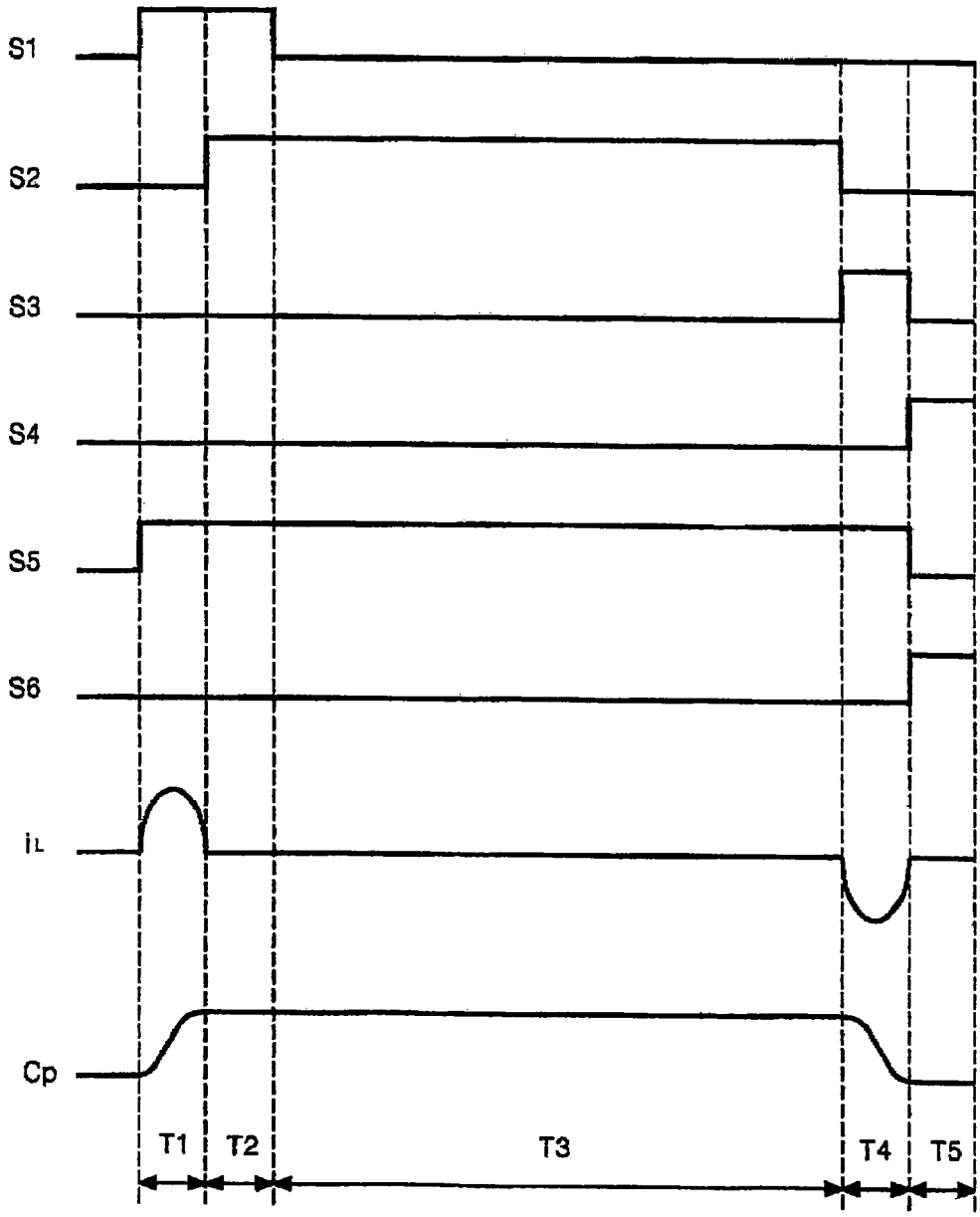
FIG. 4 RELATED ART
FIG. 4 is a waveform showing an operation process of the energy recovery apparatus of FIG. 3.
Figure 5:
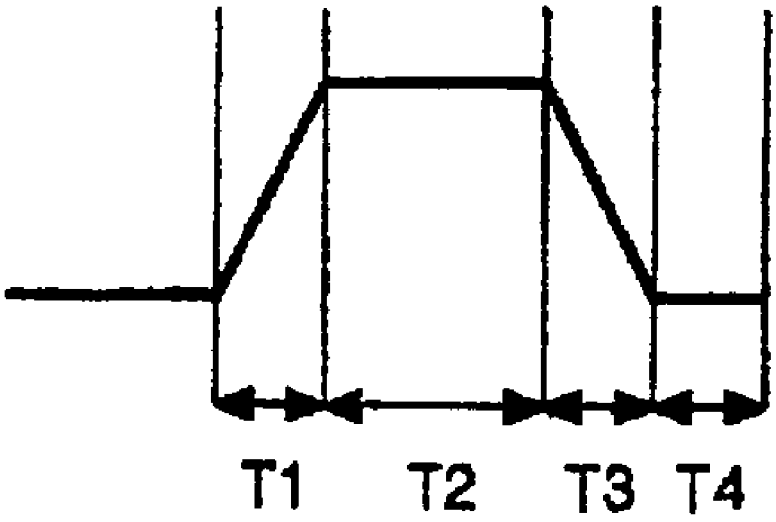
FIG. 5 RELATED ART
FIG. 5 is a view showing a driving voltage generated by the energy recovery apparatus of FIG. 3.
Figure 6:
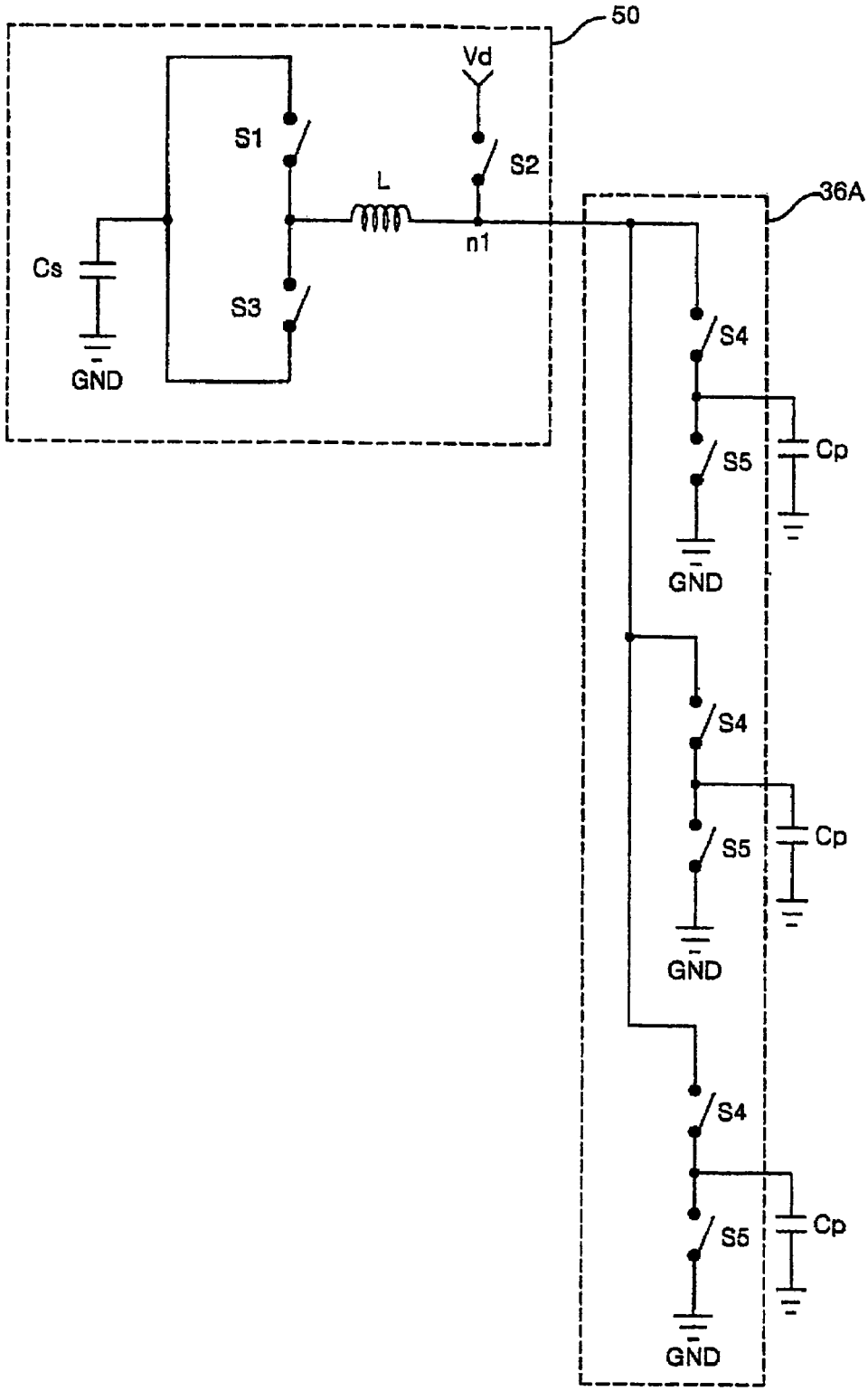
FIG. 6 RELATED ART
FIG. 6 is a view showing an energy recovery apparatus for a plasma display panel according to another embodiment of the related art.
Figure 7:
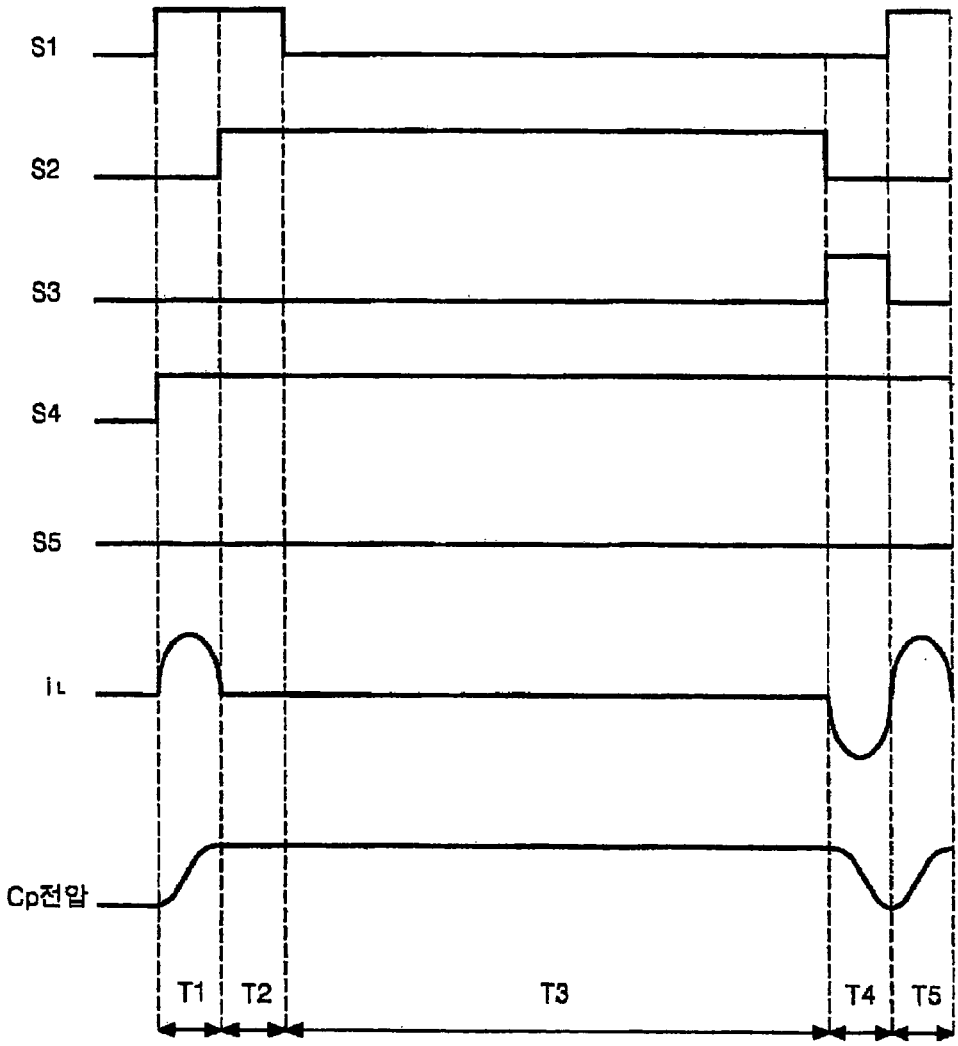
FIG. 7 RELATED ART
FIG. 7 is a waveform showing an operation process of the energy recovery apparatus of FIG. 6.
Figure 8:
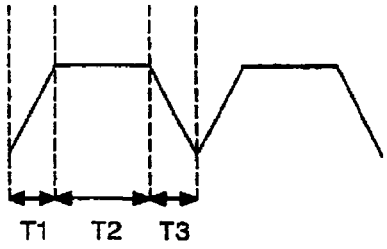
FIG. 8 RELATED ART
FIG. 8 is a view showing a driving voltage generated by the energy recovery apparatus of FIG. 6.

Operation of the energy recovery apparatus will be explained in more detail with reference to FIGS. 7 to 9.

At the initial state prior to the period of T1, a voltage of the panel capacitor Cp is supposed as 0. Also, it is supposed that a predetermined voltage is charged to the energy recovery capacitor Cs.

In the period of T1, the first and fourth switches S1 and S4 are turned on. At this time, if a discharge cell is not selected, that is, if a data pulse is not supplied to the panel capacitor Cp, the fourth switch S4 sustains the turn-off state. When the first and fourth switches S1 and S4 are turned on, a current path connected to the panel capacitor Cp from the energy recovery capacitor Cs via the first switch S1, the inductor L, the fourth switch S4 is formed. The inductor L and the panel capacitor Cp form a serial resonance circuit thereby to supply the address voltage Vd to the panel capacitor Cp.

In the period of T2, the second switch S2 is turned on. If the second switch S2 is turned on, the address voltage Vd is supplied to the panel capacitor Cp. The supplied address voltage Vd prevents the voltage of the panel capacitor Cp from being dropped to a voltage less than the address voltage Vd thereby to cause a stable address discharge.

In the period of T3, the first switch S1 is turned off, and the second switch S2 sustains the turned-on state. According to this, the panel capacitor Cp sustains the address voltage Vd during the period of T3.

In the period of T4, the second switch S2 is turned off, and the third switch S3 is turned on. When the third switch S3 is turned on, a current path connected from the panel capacitor Cp to the energy recovery capacitor Cs via the fourth switch S4, the inductor L, and the third switch S3 is formed. According to this, the charged voltage of the panel capacitor Cp is recovered to the energy recovery capacitor Cs.

In the period of T5, an address pulse is supplied to the address electrode line X by repeating the operation during the period of T1. Substantially, a data pulse is supplied to the panel capacitor Cp by repeating the operations during the periods of T1 to T4.

That is, in the energy recovery apparatus of the present invention, an addressing of a high speed can be performed without a period for sustaining the voltage charged to the energy recovery capacitor Cs.

Figure 10:
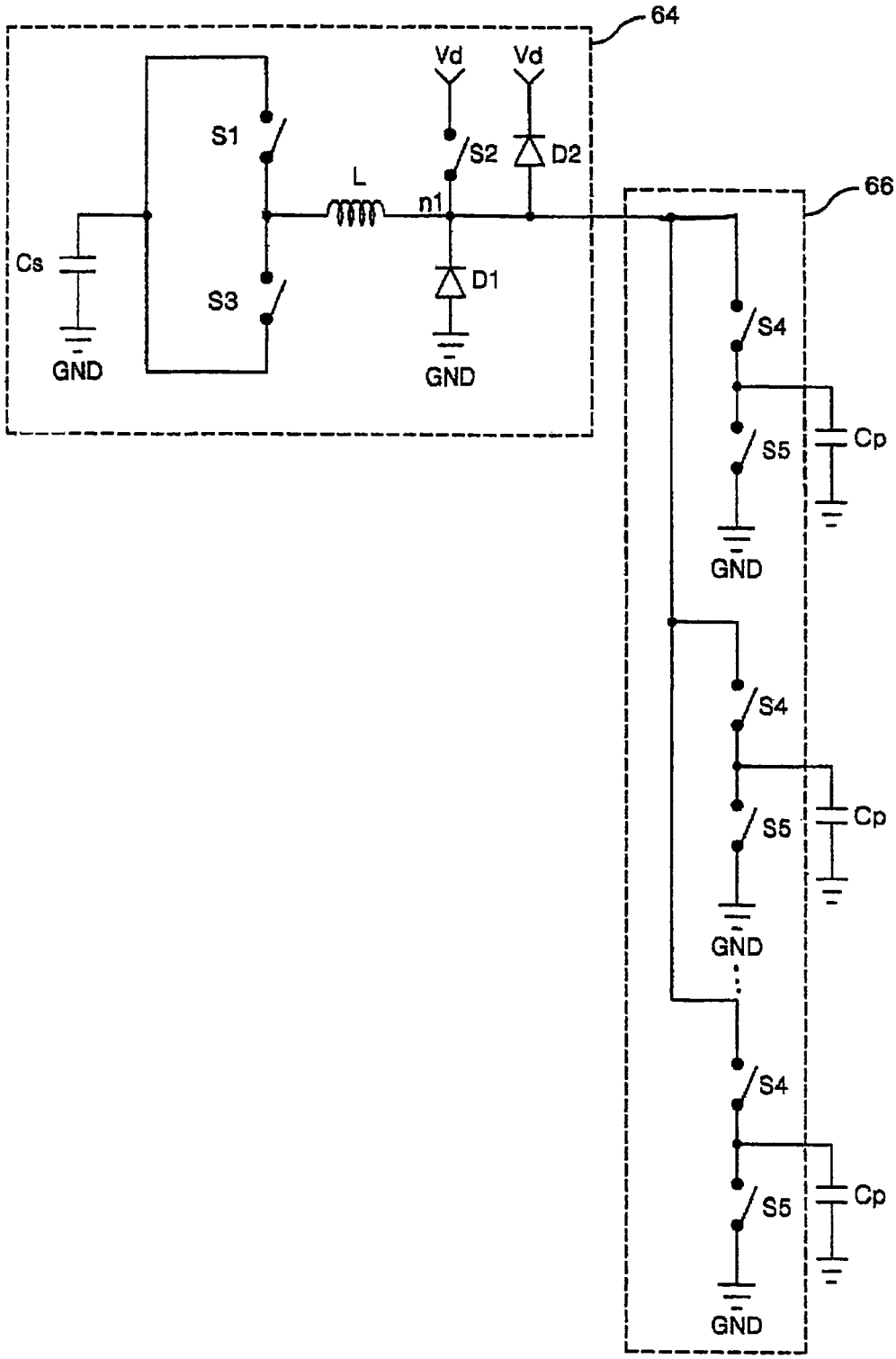
FIG. 10 is a circuit diagram showing an energy recovery apparatus according to a second embodiment of the present invention.

FIG. 10 is a view showing an energy recovery apparatus according to another embodiment of the present invention.

Referring to FIG. 10, an energy recovery apparatus 64 according to another embodiment of the present invention comprises: an inductor L connected between an address driving unit 66 and an energy recovery capacitor Cs; first and third switches S1 and S3 connected between the energy recovery capacitor Cs and the inductor L in parallel; a second switch S2 connected between the inductor L and the address driving unit 66; and a first diode D1 and a second diode D2. A panel capacitor Cp shows a static capacitance of a discharge cell.

The second switch S2 is connected to the voltage source Vd. The energy recovery capacitor Cs recovers a voltage charged to the panel capacitor Cp thus to be charged, and re-supplies the charged voltage to the panel capacitor Cp. At this time, the voltage charged to the energy recovery capacitor Cs is varied according to supplied data. The inductor L forms a resonance circuit together with the panel capacitor Cp. The first to third switches (S1 to S3) charge a voltage to the energy recovery capacitor Cs by being turned on/off, or supply the charged voltage to the panel capacitor Cp.

The first diode D1 is connected between the first node n1 and the ground voltage source GND, and the second diode D2 is installed between the first node n1 and the address voltage Vd. The first diode D1 prevents the voltage of the first node n1 from being dropped to a voltage less than the ground voltage. The second diode D2 prevents the voltage of the first node n1 from being increased to a voltage more than the address voltage Vd.

The diode D1 shields a voltage supplied from the first node n1, and is installed so as to supply a voltage to the first node n1 from the ground voltage source GND. When the energy recovery apparatus 64 is normally operated, a potential of the first node n1 is set to be more than the ground voltage. Therefore, when the energy recovery apparatus 64 is normally operated, a current does not flow to the first diode D1. When a negative voltage is applied to the first node n1 due to a switching operation of the address driving unit 66 or an operation of another circuit, the first node n1 and the ground voltage source GND are connected to each other via the first diode D1. At this time, a potential of the first node n1 is sustained as the ground voltage. That is, the energy recovery apparatus 64 prevents the potential of the first node n1 from being dropped to a voltage less than the ground voltage source GND. According to this, the energy recovery apparatus 64 can be stably operated.

The second diode D2 is installed so as to supply a voltage supplied from the first node n1 to the address voltage source Vd. When the energy recovery apparatus 64 is normally operated, a potential of the first node n1 is set to be less than the address voltage Vd. Therefore, when the energy recovery apparatus 64 is normally operated, a current does not flow to the second diode D2. Also, a voltage more than the address voltage Vd can be applied to the first node n1 by the switching operation of the address driving unit 66 and the operation of another circuit. The voltage applied to the first node n1 is supplied to the address voltage source Vd via the second diode D2. Therefore, the voltage of the first node n1 is always set to be less than the address voltage Vd, and thereby the energy recovery apparatus 64 can be stably operated.

The address driving unit 66 is provided with a plurality of fourth and fifth switches S4 and S5. The fourth switch S4 is connected to the energy recovery apparatus 64, and the fifth switch S5 is connected to the ground voltage source GND. The fourth switch S4 is turned on when a data pulse is supplied to the address driving unit, and is turned off when the data pulse is not supplied thereto. The energy recovery apparatus according to another embodiment of the present invention has the same operation as that of the energy recovery apparatus of FIG. 9, thereby omitting any further detailed explanations.

Figure 11:
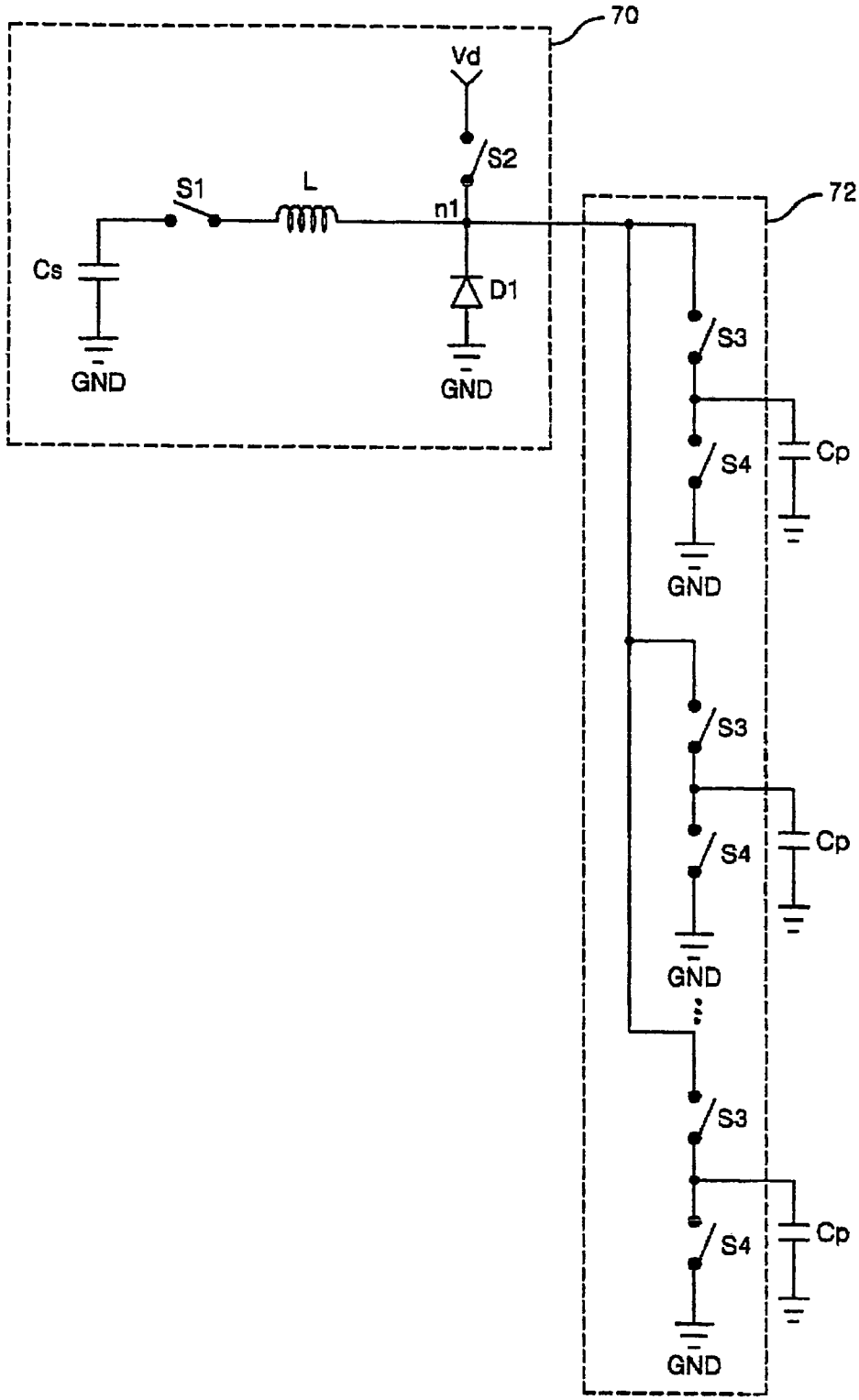
FIG. 11 is a circuit diagram showing an energy recovery apparatus according to a third embodiment of the present invention.
Figure 12:
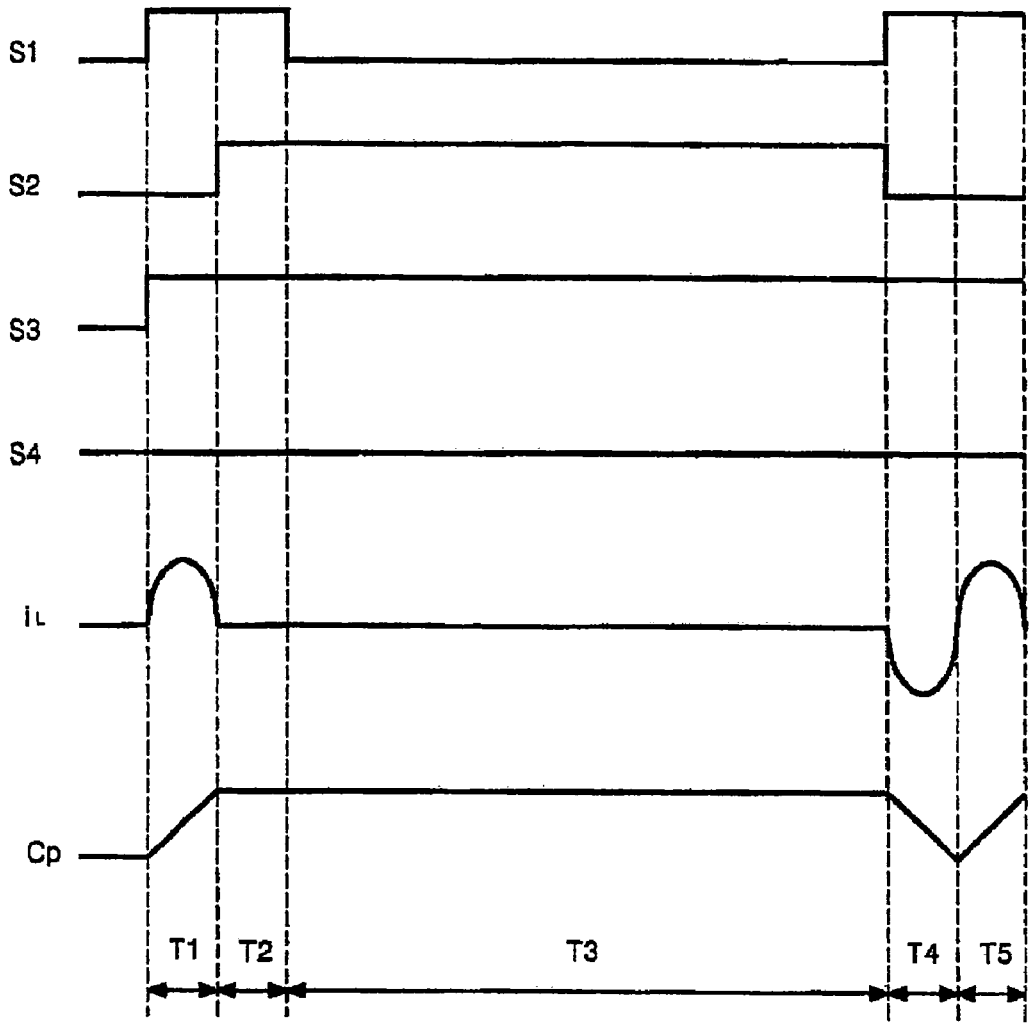
FIG. 12 is a waveform showing an operation process of the energy recovery apparatus of FIG. 11.

FIG. 11 is a view showing an energy recovery apparatus according to another embodiment of the present invention.

As shown in FIG. 11, the energy recovery apparatus according to the another embodiment of the present invention includes: an inductor L and a first switch S1 connected between an address driving unit 72 and an energy recovery capacitor Cs; and a second switch and a diode connected in parallel between the inductor L and the address driving unit 72. A panel capacitor Cp equivalently shows a static capacitance of a discharge cell.

The second switch S2 is connected to the address voltage Vd. The energy recovery capacitor Cs recovers the voltage charged to the panel capacitor Cp thus to be charged, and re-supplies the charged voltage to the panel capacitor Cp. The inductor L forms a resonance circuit together with the panel capacitor Cp. The first and second switches S1 and S2 control an energy flow by being turned on/off.

The diode D1 is connected between the first node n1 and the ground voltage source GND thereby to prevent the voltage of the first node n1 from being dropped to a voltage less than the ground voltage. More specifically, the diode D1 shields a voltage supplied from the first node n1, and supplies a voltage from the ground voltage source GND to the first node n1. When the energy recovery apparatus 70 is normally operated, a potential of the first node n1 is set to be more than the ground voltage. Therefore, when the energy recovery apparatus 70 is normally operated, a current does not flow to the first diode D1.

When a negative voltage is applied to the first node n1 due to a switching operation of the address driving unit 72 or an operation of another circuit, the first node n1 and the ground voltage source GND are connected to each other via the diode D1. At this time, a potential of the first node n1 is sustained as the ground voltage. That is, the energy recovery apparatus 70 according to the another embodiment of the present invention prevents the potential of the first node n1 from being dropped to a voltage less than the ground voltage. According to this, the energy recovery apparatus 70 can be stably operated.

The address driving unit 72 is provided with a plurality of third and fourth switches S3 and S4. The third switch S3 is connected to the energy recovery apparatus 70, and the fourth switch S4 is connected to the ground voltage source GND. The third switch S3 is turned on when a data pulse is supplied to the address driving unit, and is turned off when the data pulse is not supplied thereto. Operation of the energy recovery apparatus according to the another embodiment of the present invention will be explained in more detail with reference to FIG. 12.

At the initial state prior to the period of T1, a voltage of the panel capacitor Cp is supposed as 0. Also, it is supposed that a voltage of Vd/2 is charged to the energy recovery capacitor Cs.

In the period of T1, the first and third switches S1 and S3 are turned on. At this time, if a discharge cell is not selected, that is, if a data pulse is not supplied to the panel capacitor Cp, the third switch S3 sustains the turn-off state. When the first and third switches S1 and S3 are turned on, a current path connected from the energy recovery capacitor Cs to the panel capacitor Cp through the first switch S1, the inductor L, the third switch S3 is formed. The inductor L and the panel capacitor Cp form a serial resonance circuit. Since the voltage of Vd/2 was charged to the energy recovery capacitor Cs, the voltage of the panel capacitor Cp is increased up to the address voltage Vd corresponding to twice of the energy recovery capacitor Cs by charging/discharging the current of the inductor L in the serial resonance circuit.

In the period of T2, the second switch S2 is turned on. If the second switch S2 is turned on, the address voltage Vd is supplied to the panel capacitor Cp. The supplied address voltage Vd prevents the voltage of the panel capacitor Cp from being dropped to a voltage less than the address voltage Vd thereby to cause a stable address discharge. Since the voltage of the panel capacitor Cp was increased up to the address voltage Vd, an external driving power for generating an address discharge is minimized.

In the period of T3, the first switch S1 is turned off, and the voltage Vd supplied to the address electrode line X is sustained.

In the period of T4, the second switch S2 is turned off and the first switch S1 is turned on. When the first switch S1 is turned on, a current path connected from the panel capacitor Cp to the energy recovery capacitor Cs via the third switch S3, the inductor L, and the first switch S1 is formed. According to this, the charged voltage of the panel capacitor Cp is recovered to the energy recovery capacitor Cs thereby to charge the voltage of Vd/2 to the energy recovery capacitor Cs.

Since the first switch S1 sustains the turn-off state, the voltage charged to the energy recovery capacitor Cs is re-supplied to the panel capacitor Cp via the first switch S1, the inductor L, and the third switch S3 (the period of T1). In the energy recovery apparatus according to the another embodiment of the present invention, a voltage is charged to the energy recovery capacitor Cs, and the charged voltage is again discharged thereby to perform an addressing of a high speed. Also, the energy recovery apparatus 70 prevents the voltage of the first node n1 from being dropped to a voltage less than the ground voltage thereby to enable a stable operation.

Figure 13:
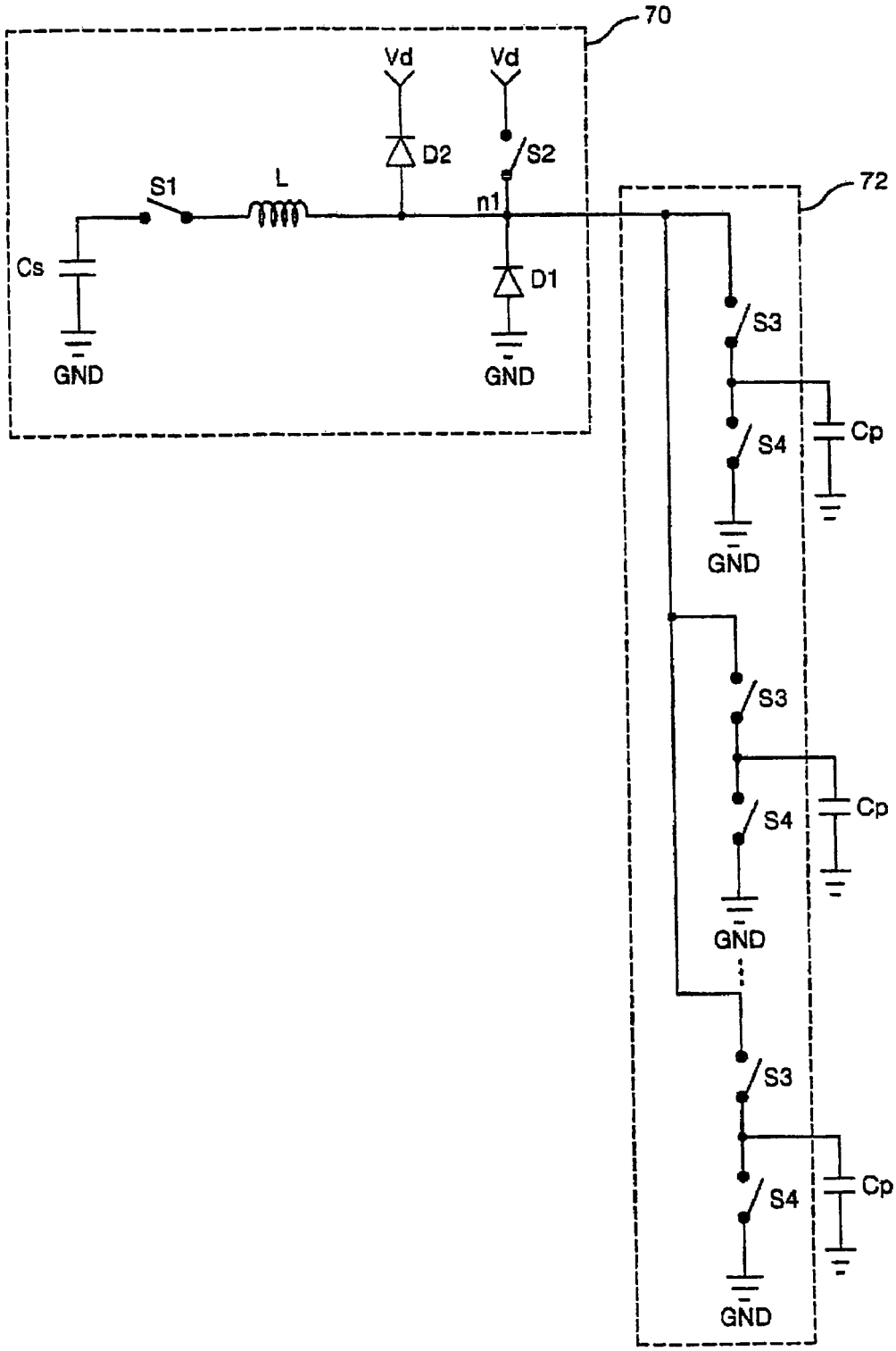
FIG. 13 is a circuit diagram showing an energy recovery apparatus according to a fourth embodiment of the present invention.

According to the another embodiment of the present invention, as shown in FIG. 13, a second diode D2 can be installed between the address voltage source Vd and the first node n1. The second diode D2 is installed to supply the voltage supplied from the first node n1 to the address voltage source Vd, thereby preventing the voltage of the first node n1 from being increased to a voltage more than the address voltage. Therefore, the voltage of the first node n1 is always set to be less than the address voltage Vd, thereby enabling a stable operation.

As aforementioned, in the energy recovery apparatus for a plasma display panel, the voltage of the energy recovery apparatus is set to be more than the ground voltage or less than the address voltage thereby to enable a stable operation. That is, the voltage variation of the energy recovery apparatus due to an abnormal voltage supplied from outside is prevented, and thereby a stable energy supply and a recovery operation can be performed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An energy recovery apparatus for a plasma display panel comprising:

a capacitance loads equivalently formed at a discharge cell;

an inductor for forming a resonance circuit together with the capacitance loads;

an energy recovery capacitor for recovering energy of the capacitance loads thus to be charged;

switching units installed between the capacitance loads and the energy recovery capacitor, for controlling a charging/discharging of the capacitance loads; and a voltage sustain diode installed between the inductor and a ground voltage source, for preventing a voltage between the inductor and the capacitance loads from being dropped to a voltage less than a ground voltage.

2. The apparatus of claim 1, wherein the switching units do not include a switching unit installed between the capacitance loads and the ground voltage source so as to omit a reset period for connecting the capacitance loads and the ground voltage source.

3. The apparatus of claim 1, wherein the switching units include:

first and second switching units connected in parallel between the inductor and the energy recovery capacitor; and a third switching unit installed between the inductor and an address driving unit and connected to an address voltage source.

4. The apparatus of claim 3 further comprising a voltage limiting diode installed between the inductor and the address voltage source in order to prevent a voltage between the inductor and the capacitance loads from being increased to a voltage more than the address voltage.

5. An energy recovery apparatus for a plasma display panel comprising:

a capacitance loads equivalently formed at a discharge cell;

an inductor for forming a resonance circuit together with the capacitance loads;

an energy recovery capacitor for recovering energy of the capacitance loads thus to be charged;

a first switching unit installed between the capacitance loads and the inductor, for sustaining a short circuit state when the capacitance loads and the energy recovery capacitor are charged/discharged; and a voltage sustain diode installed between the inductor and a ground voltage source, for preventing a voltage between the inductor and the capacitor from being dropped to a voltage less than a ground voltage.

6. The apparatus of claim 5 further comprising:

an address voltage source; and a second switching unit installed between the address voltage source and the inductor and turned on when a voltage of the capacitance loads is sustained as a voltage of the address voltage source.

7. The apparatus of claim 6 further comprising a voltage limiting diode installed between the inductor and the address voltage source in order to prevent a voltage between the inductor and the capacitance loads from being increased to a voltage more than the address voltage.

8. An energy recovery apparatus for a plasma display panel comprising:

an address electrode driving unit having a power supply unit to supply drive power to each of a plurality of address electrode lines of a plasma display panel;

an external capacitor to recover a charged voltage from capacitance loads formed on each of the plurality of address electrode lines, the voltage charged in the capacitor varying according to an amount of data on the plurality of the address electrode lines;

an inductor to form a resonant circuit with the capacitance loads so as to charge and discharge the external capacitor;

a switching device unit connected between the inductor and the external capacitor, the switching device controlling charging and discharging of the external capacitor;

a voltage sustain diode installed between the inductor and a ground voltage source, for preventing a voltage between the inductor and the capacitance loads from being dropped to a voltage less than a ground voltage; and a voltage limiting diode installed between the inductor and an address voltage source in order to prevent a voltage between the inductor and the capacitance loads from being increased to a voltage more than the address voltage.

* * * * *